US010442198B2

(12) United States Patent
Higashibeppu

(10) Patent No.: US 10,442,198 B2
(45) Date of Patent: Oct. 15, 2019

(54) NOZZLE PLATE, LIQUID EJECTION HEAD INCLUDING NOZZLE PLATE, AND RECORDING DEVICE

(71) Applicant: KYOCERA Corporation, Kyoto-shi, Kyoto (JP)

(72) Inventor: Makoto Higashibeppu, Kyoto (JP)

(73) Assignee: KYOCERA CORPORATION, Kyoto-Shi, Kyoto (JP)

( * ) Notice: Subject to any disclaimer, the term of this patent is extended or adjusted under 35 U.S.C. 154(b) by 0 days.

(21) Appl. No.: 15/763,730

(22) PCT Filed: Sep. 16, 2016

(86) PCT No.: PCT/JP2016/077450

§ 371 (c)(1),
(2) Date: Mar. 27, 2018

(87) PCT Pub. No.: WO2017/057063

PCT Pub. Date: Apr. 6, 2017

(65) Prior Publication Data

US 2018/0304628 A1 Oct. 25, 2018

(30) Foreign Application Priority Data

Sep. 28, 2015 (JP) ..... 2015-189896

(51) Int. Cl.
*B41J 2/14* (2006.01)
*B41J 2/16* (2006.01)

(52) U.S. Cl.
CPC ..... *B41J 2/1433* (2013.01); *B41J 2/14* (2013.01); *B41J 2/16* (2013.01); *B41J 2/162* (2013.01);

(Continued)

(58) Field of Classification Search
CPC ..... B41J 2/14; B41J 2/1433; B41J 2/16; B41J 2/1606; B41J 2/1607; B41J 2/162; B41J 2/1625; B41J 2/164; B41J 2/1643
See application file for complete search history.

(56) References Cited

U.S. PATENT DOCUMENTS 6,045,215 A 4/2000 Coulman
6,054,011 A * 4/2000 Radke ..... B41J 2/14024 156/326

(Continued)

FOREIGN PATENT DOCUMENTS

CN 1472074 A 2/2004
CN 101351341 A 1/2009

(Continued)

OTHER PUBLICATIONS

International Search Report, PCT/JP2016/077450, dated Dec. 6, 2016, 2 pgs.

*Primary Examiner* — Anh T Vo
(74) *Attorney, Agent, or Firm* — Volpe and Koenig, P.C.

(57) ABSTRACT

A nozzle plate includes a base having a through-hole to be a nozzle, and a metal film covering at least an inner wall of the through-hole of the base. The base contains nickel as a main component. The metal film contains nickel and palladium as main components. In a cross section including the base and the metal film, the metal film has a palladium content variation smaller than or equal to 4 at % on an imaginary line (A) along an interface between the base and the metal film.

7 Claims, 5 Drawing Sheets

(52) U.S. Cl.
CPC ..... *B41J 2/1606* (2013.01); *B41J 2/1607* (2013.01); *B41J 2/1625* (2013.01); *B41J 2/1643* (2013.01); *B41J 2/164* (2013.01)

(56) References Cited

U.S. PATENT DOCUMENTS

| | | | | |
|---|---|---|---|---|
| 6,145,963 | A | 11/2000 | Pidwerbecki et al. | |
| 6,328,420 | B1 | 12/2001 | Koyama et al. | |
| 8,109,614 | B2 * | 2/2012 | Giovanola ..... | B41J 2/1404 347/45 |
| 2002/0121274 | A1 | 9/2002 | Borland et al. | |
| 2004/0088859 | A1 | 5/2004 | Ito et al. | |
| 2007/0097176 | A1 | 5/2007 | Hickey et al. | |

FOREIGN PATENT DOCUMENTS

| | | | |
|---|---|---|---|
| JP | 11-129483 | A | 5/1999 |
| JP | 11-300976 | A | 11/1999 |
| JP | 2000-079695 | A | 3/2000 |
| JP | 2005-131949 | A | 5/2005 |
| JP | 2007-230152 | A | 9/2007 |
| JP | 2009-166278 | A | 7/2009 |
| JP | 2011-088388 | A | 5/2011 |

* cited by examiner

NOZZLE PLATE, LIQUID EJECTION HEAD INCLUDING NOZZLE PLATE, AND RECORDING DEVICE

FIELD

The present invention relates to a nozzle plate, a liquid ejection head including the nozzle plate, and a recording device.

BACKGROUND

Nozzle plates known for a liquid ejection head may contain nickel as a main component (refer to, for example, Patent Literature 1).

CITATION LIST

Patent Literature

Patent Literature 1: Japanese Patent Application Publication No. 2005-131949

BRIEF SUMMARY

A nozzle plate according to one aspect of the present disclosure includes a base having a through-hole to be a nozzle, and a metal film covering at least an inner wall of the through-hole of the base. The base contains nickel as a main component. The metal film contains nickel and palladium as main components. In a cross section including the base and the metal film, the metal film has a palladium content variation smaller than or equal to 4 at % on an imaginary line along an interface between the base and the metal film.

A liquid ejection head according to one aspect of the present disclosure includes the nozzle plate, a plurality of pressurizing chambers connecting to a corresponding plurality of the through-holes, and a plurality of pressurizers that pressurize the corresponding plurality of pressurizing chambers.

A recording device according to one aspect of the present disclosure includes the liquid ejection head, a transport unit that transports a recording medium to the liquid ejection head, and a controller that controls the liquid ejection head.

DETAILED DESCRIPTION

Figure 1A:
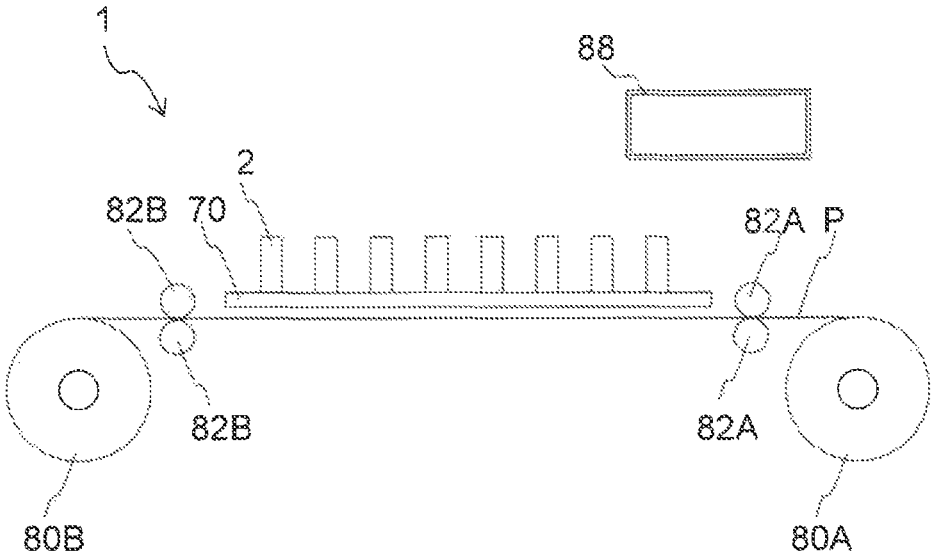
FIG. 1A is a side view of a recording device including a liquid ejection head according to an embodiment of the present disclosure.
Figure 1B:
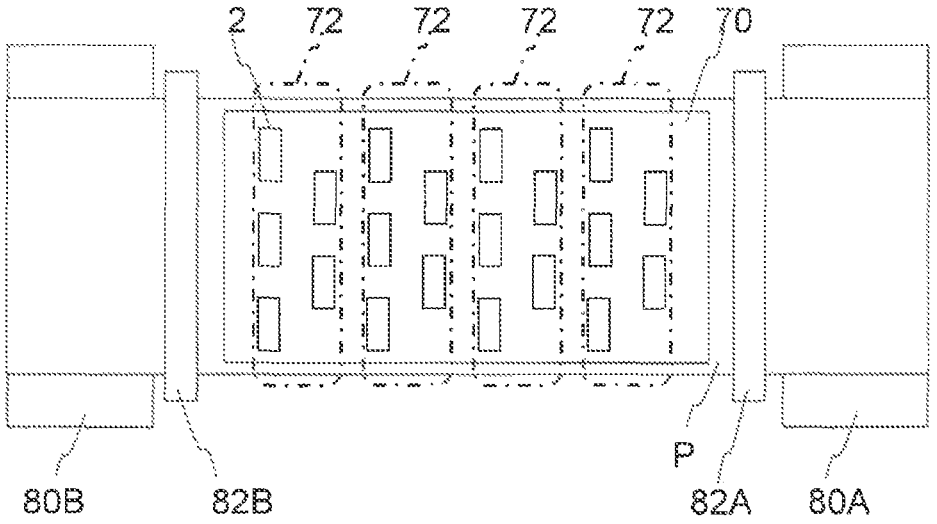
FIG. 1B is a plan view of the recording device.

FIG. 1A is a schematic side view of a color inkjet printer 1 (hereinafter also simply referred to as a printer), which is a recording device including liquid ejection heads 2 according to an embodiment of the present disclosure. FIG. 1B is a schematic plan view of the printer 1. The printer 1 transports print paper P, which is a recording medium, from guide rollers 82A to transport rollers 82B to move the print paper P relative to the liquid ejection heads 2. A controller 88 controls the liquid ejection heads 2 based on data about images or texts. The controller 88 causes the liquid ejection heads 2 to eject a liquid to the print paper P in the form of droplets to record the data on the print paper P by, for example, printing.

In the present embodiment, the liquid ejection heads 2 are fixed to the printer 1, which is a line printer. The recording device according to another embodiment of the present disclosure may be a serial printer that alternately transports the print paper P and moves the liquid ejection heads 2 in a direction crossing a transport direction of the print paper P, for example, reciprocates the liquid ejection heads 2 in a direction substantially perpendicular to the transport direction.

A flat head mount frame 70 (or also simply referred to as a frame) is fixed to the printer 1 to extend substantially parallel to the print paper P. The frame 70 has twenty holes (not shown) in which the twenty liquid ejection heads 2 are mounted. Each liquid ejection head 2 has a liquid ejection part to face the print paper P. The distance between the liquid ejection head 2 and the print paper P ranges from, for example, about 0.5 to 20 mm. Five liquid ejection heads 2 form one head group 72. The printer 1 includes four head groups 72.

Each liquid ejection head 2 is elongated in a direction from the near side to the far side in FIG. 1A, or in the vertical direction in FIG. 1B. This direction may be referred to as a longitudinal direction. Each head group 72 includes three liquid ejection heads 2 arranged in a direction crossing the transport direction of the print paper P in, for example, a direction substantially perpendicular to the transport direction, and two liquid ejection heads 2, which are spaced from the three liquid ejection heads 2 in the transport direction to cover spaces between the three liquid ejection heads 2. The liquid ejection heads 2 are arranged for continuously and entirely printing the print paper P in the widthwise direction (in the direction crossing the transport direction of the print paper P) or to have their ends overlapping each other. Thus, the liquid ejection heads 2 can perform continuous printing on the print paper P in the widthwise direction without leaving any blanks.

The four head groups 72 are arranged in the transport direction of the print paper P. Liquid, which is for example ink, is supplied to each liquid ejection head 2 from a liquid tank (not shown). The same color ink is supplied to the liquid ejection heads 2 in the same head group 72. The four head groups 72 thus enable printing with four colors of ink. The colors of ink ejected from the respective head groups 72 are, for example, magenta (M), yellow (Y), cyan (C), and black (K). The controller 88 controls printing with ink of such colors to print a color image.

The printer 1 may include a single liquid ejection head 2 for printing a monochrome image over an area printable by the single liquid ejection head 2. The number of liquid ejection heads 2 in each head group 72 or the number of head groups 72 may be changed in accordance with an object to be printed or the printing conditions. For example, the printer 1 may include more head groups 72 for printing with more colors. The printer 1 may include multiple head groups 72 for printing with the same color alternately printing in the transport direction to accelerate transportation with the liquid ejection heads 2 having the same capabilities. This structure can increase the printable area per unit time. In some embodiments, multiple head groups 72 for printing with the same color may be spaced from one another in the direction crossing the transport direction to increase the resolution in the widthwise direction of the print paper P.

Moreover, the printer 1 may be used to treat the surface of the print paper P with a liquid such as a coating agent, instead of printing colored ink printed on the surface.

The printer 1 prints on the print paper P, which is a recording medium. The print paper P is wound around a feed roller 80A. The print paper P passes between two guide rollers 82A, and then under the liquid ejection heads 2 mounted on the frame 70, and between two transport rollers 82B, and is finally rewound by a rewind roller 80B. In printing, the print paper P is transported at a constant speed by rotating the transport rollers 82B, and undergoes printing with the liquid ejection heads 2. The rewind roller 80B rewinds the print paper P fed from the transport rollers 82B. The transport speed is, for example, 75 m/min. Each roller may be controlled by the controller 88 or manually by an operator.

The recording medium may be a roll of cloth, instead of the print paper P. The printer 1 may directly transport a transport belt carrying recording media, instead of directly transporting the print paper P. The recording media may be materials such as cut sheets of paper, or cut pieces of cloth, wooden sheets, or tiles. The liquid ejection heads 2 may eject a liquid containing electrically conductive particles to print a wiring pattern of an electronic device. The liquid ejection heads 2 may further eject a predetermined amount of liquid chemical agent or liquid containing a chemical agent to, for example, a reaction container to produce chemicals through reactions for example.

The printer 1 may include, for example, a position sensor, a speed sensor, or a temperature sensor, which are used by the controller 88 to control the components of the printer 1 in accordance with the states of the components determined using information from each sensor. For example, when the ejection performance, including the amount of liquid ejected or the speed at which the liquid is ejected, is affected by the properties such as the temperature of the liquid ejection heads 2, the temperature of the liquid in the liquid tank, or the pressure of the liquid in the liquid tank applied on the liquid ejection heads 2, the controller 88 may change driving signals for ejecting the liquid in accordance with information about these properties.

Figure 2:
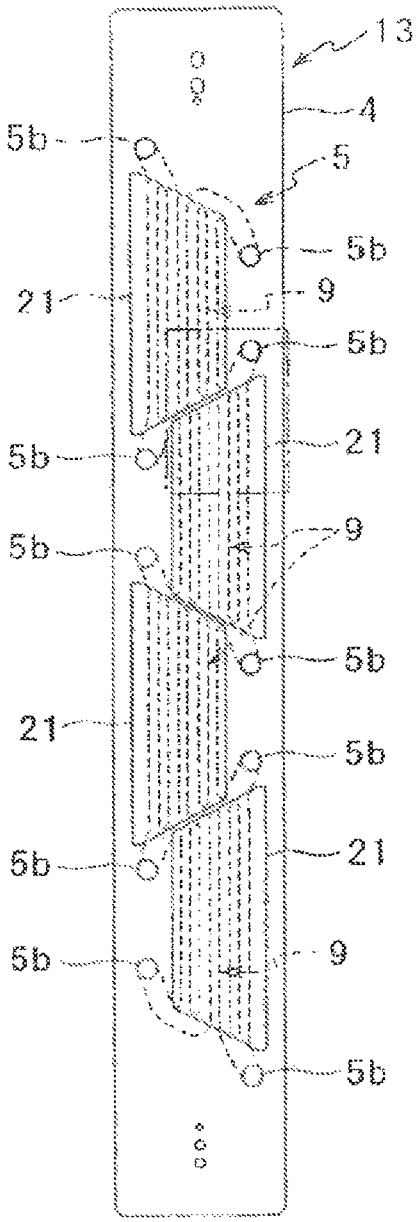
FIG. 2 is a plan view of a head body included in the liquid ejection head shown in FIGS. 1A and 1B.
Figure 3:
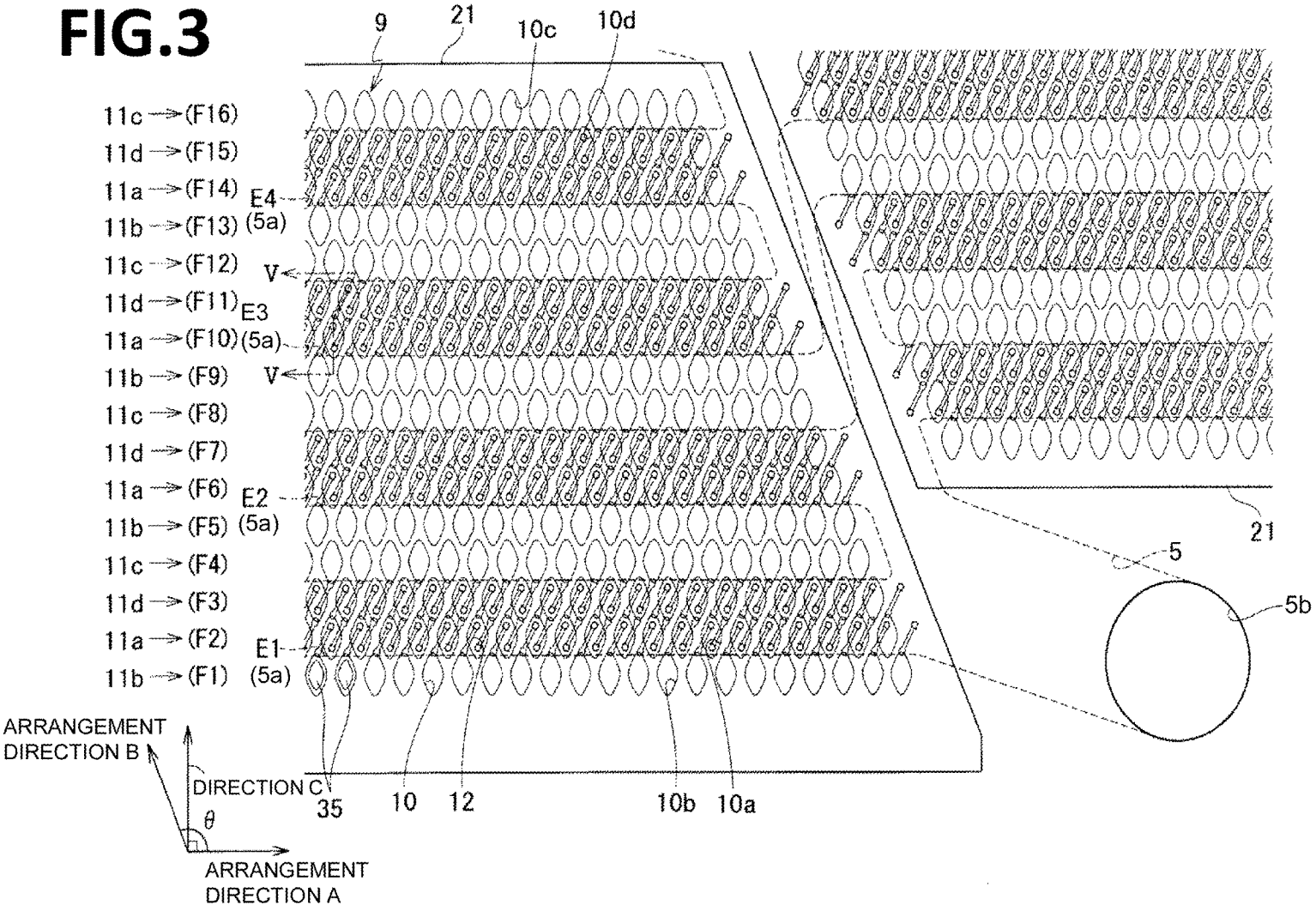
FIG. 3 is an enlarged diagram of an area indicated by a dot-and-dash line in FIG. 2, and a plan view excluding some flow channels for illustration purposes.
Figure 4:
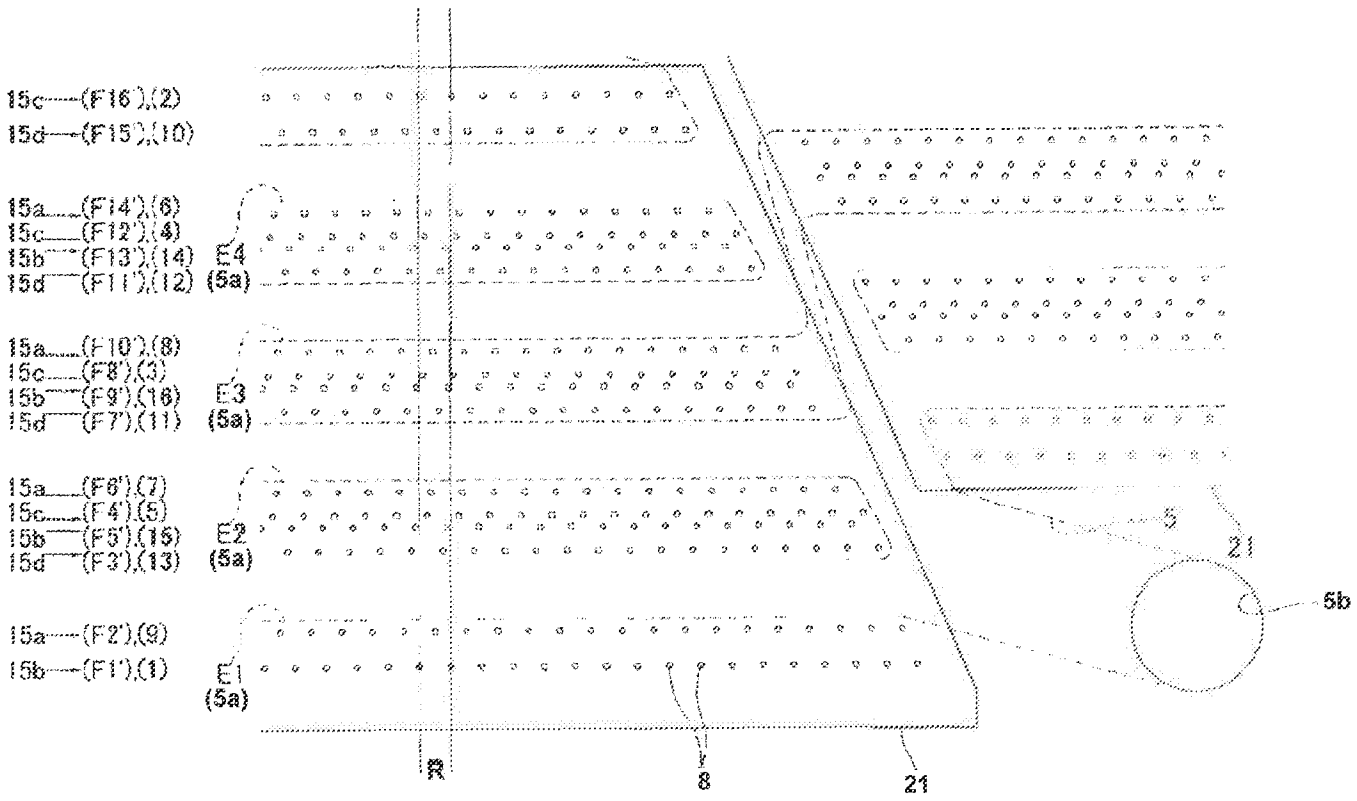
FIG. 4 is an enlarged diagram of an area indicated by the dot-and-dash line in FIG. 2, and a plan view excluding some flow channels for illustration purposes.
Figure 5A:
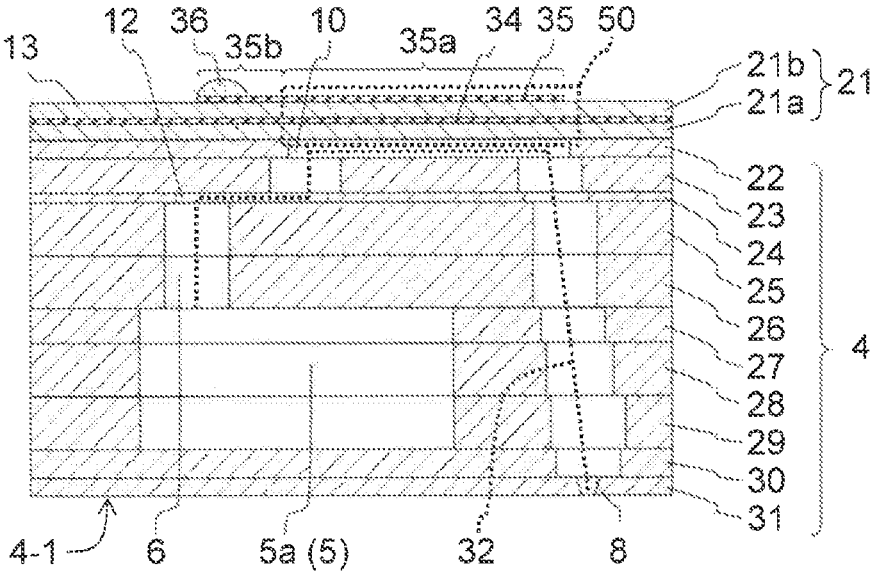
FIG. 5A is a vertical section taken along line V-V in FIG. 3.
Figure 5B:
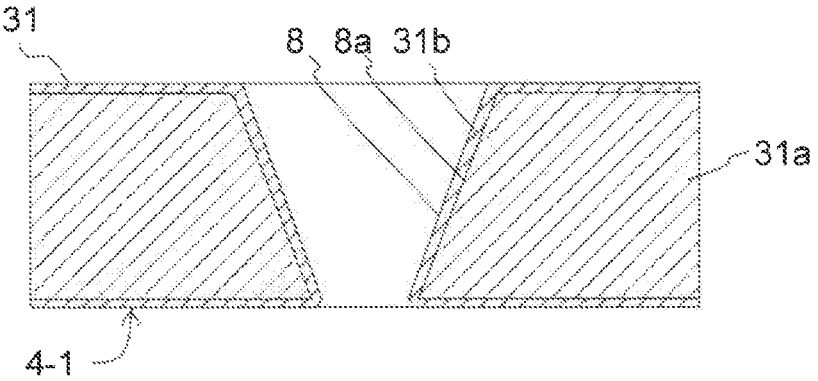
FIG. 5B is an enlarged vertical section of an ejection orifice shown in FIG. 5A.
Figure 5C:
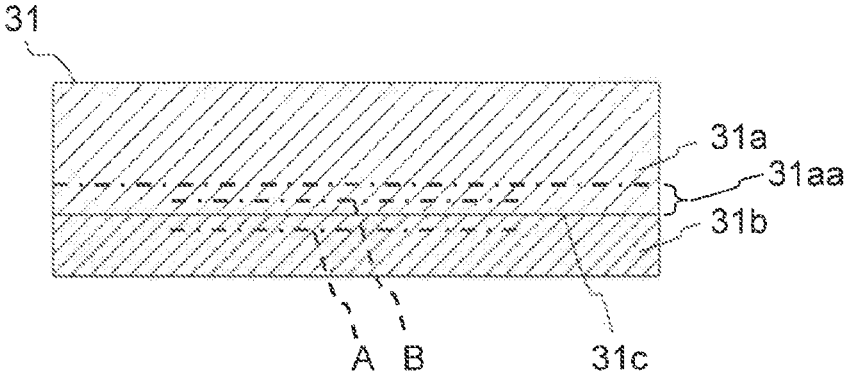
FIG. 5C is a further enlarged vertical section of part of the ejection orifice shown in FIG. 5B.

The liquid ejection heads 2 according to the embodiment of the present disclosure will now be described. FIG. 2 is a plan view of a head body 13 of the liquid ejection head 2, which is a main part of the liquid ejection head 2 shown in FIGS. 1A and 1B. FIG. 3 is an enlarged plan view of the area indicated by the dot-and-dash line in FIG. 2, showing a part of the head body 13. FIG. 4 is an enlarged plan view of the same part as shown in FIG. 3. To simplify the drawings, FIGS. 3 and 4 do not show some channels. For illustration purposes in FIGS. 3 and 4, components located under a piezoelectric actuator substrate 21, such as pressurizing chambers 10, apertures 12, and ejection orifices 8, are drawn with solid lines, instead of broken lines. FIG. 5A is a vertical cross-sectional view taken along line V-V in FIG. 3. FIG. 5B is an enlarged vertical cross-sectional view of one ejection orifice 8 formed in a nozzle plate 31. FIG. 5C is a further enlarged vertical cross-sectional view of the nozzle plate 31.

The head body 13 includes a flat channel 4 and piezoelectric actuator substrates 21 located on the channel 4. The channel 4 includes a nozzle plate 31 having ejection orifices, and a channel body including plates 22 to 30 stacked on one another, which is located on the nozzle plate 31. The piezoelectric actuator substrates 21, which are trapezoidal, are arranged on the upper surface of the channel 4 with the facing parallel sides of the trapezoid of each substrate being parallel to the longitudinal direction of the channel 4. The four piezoelectric actuator substrates 21 are arranged on the channel 4 in a staggered manner, in which two piezoelectric actuator substrates 21 in each pair are along two imaginary lines parallel to the longitudinal direction of the channel 4. The oblique sides of the piezoelectric actuator substrates 21 adjacent to one another on the channel 4 partially overlap in the lateral direction of the channel 4. When the piezoelectric actuator substrates 21 are driven to print an image, droplets ejected from the adjacent two piezoelectric actuator substrates 21 having their oblique sides overlapping in the lateral direction are mixed and applied in the same area of the image.

The channel 4 has manifolds 5, which are parts of liquid channels. The manifolds 5 are elongated in the longitudinal direction of the channel 4. The channel 4 has openings 5*b* of the manifolds 5 in the upper surface. The openings 5*b* are ten openings in total, or specifically two sets of five openings arranged correspondingly on two imaginary lines parallel to the longitudinal direction of the channel 4. The openings 5*b* are located in areas other than the areas in which the four piezoelectric actuator substrates 21 are arranged. A liquid is supplied to the manifolds 5 through the openings 5*b* from a liquid tank (not shown).

Each manifold 5 in the channel 4 diverges into multiple sections (such diverging sections of each manifold 5 may also be referred to as sub-manifolds 5*a*). Parts of each manifold 5 continuous to the openings 5*b* extend along the oblique sides of the piezoelectric actuator substrates 21 to cross the longitudinal direction of the channel 4. In an area between two piezoelectric actuator substrates 21, one manifold 5 is shared with the adjacent piezoelectric actuator substrates 21, and has sub-manifolds 5*a* diverging from both sides of the manifold 5. These sub-manifolds 5*a* extend adjacent to one another in the longitudinal direction of the head body 13 in the area inside the channel 4, which corresponds to the piezoelectric actuator substrates 21.

The channel 4 includes four pressurizing chamber groups 9, each of which includes a matrix of multiple pressurizing chambers 10 (arranged two-dimensionally regularly). Each pressurizing chamber 10 is a hollow space having a flat, substantially rhombus shape with rounded corners. Each pressurizing chamber 10 is open in the upper surface of the channel 4. The pressurizing chambers 10 are arranged substantially in the entire area of the upper surface of the channel 4 facing the piezoelectric actuator substrates 21. Each pressurizing chamber group 9 including the pressurizing chambers 10 uses the area having substantially the same size and the same shape as the area of the corresponding piezoelectric actuator substrate 21. The opening of each pressurizing chamber 10 is closed with the piezoelectric actuator substrate 21 bonded to the upper surface of the channel 4.

In the present embodiment, as shown in FIG. 3, the manifold 5 branches into four rows E1 to E4 of sub-manifolds 5*a* arranged parallel to one another in the lateral direction of the channel 4. The pressurizing chambers 10 continuous with each sub-manifold 5*a* form a row of pressurizing chambers 10, which are arranged at equal intervals in the longitudinal direction of the channel 4. Four rows of the pressurizing chambers 10 are arranged parallel to one another in the lateral direction. Two rows of the pressurizing chambers 10 continuous with each sub-manifold 5*a* are arranged on each of the two sides of the sub-manifold 5*a*.

The pressurizing chambers 10 continuous with the manifolds 5 as a whole form 16 rows of the pressurizing chambers 10, which are arranged at equal intervals in the longitudinal direction of the channel 4. The rows are arranged parallel to one another in the lateral direction. In correspondence with the contour of a displacement element 50 serving as an actuator, each pressurizing chamber row includes gradually fewer pressurizing chambers 10 from the longer side toward the shorter side.

Ejection orifices 8, which serve as nozzles, are arranged at substantially equal intervals of about 42 μm (25.4 mm/150=42 μm at 600 dpi) in the longitudinal direction, which is the resolution direction of the head body 13. Thus, the head body 13 can form images at a resolution of 600 dpi in its longitudinal direction. In the area where two piezoelectric actuator substrates 21 having a trapezoid shape overlap each other, the ejection orifices 8 under the two piezoelectric actuator substrates 21 are arranged complementarily to each other. Thus, the ejection orifices 8 are formed at the intervals corresponding to the resolution of 600 dpi in the longitudinal direction of the head body 13.

Individual channels 32 connect to each sub-manifold 5*a* at intervals corresponding to the average resolution of 150 dpi. In designing the ejection orifices 8 for the resolution of 600 dpi to be connected to four separate rows of the sub-manifolds 5*a*, the individual channels 32 may not be connected at equal intervals to the sub-manifolds 5*a*. The individual channels 32 are thus arranged at average intervals smaller than or equal to 170 μm (25.4 mm/150=169 μm at 150 dpi) in the direction in which the manifolds 5*a* extend, or in the main scanning direction.

Individual electrodes 35 (described below) are located on the upper surface of each piezoelectric actuator substrate 21 at the positions corresponding to the pressurizing chambers 10. Each individual electrode 35 is slightly smaller than the corresponding pressurizing chamber 10 and has the shape substantially similar to the shape of the pressurizing chamber 10 to fall within an area of the upper surface of the piezoelectric actuator substrate 21 corresponding to the pressurizing chamber 10.

A large number of ejection orifices 8 are open in an ejection orifice surface 4-1, which is the lower surface of the channel 4. The ejection orifices 8 are formed in areas other than in the area corresponding to the sub-manifolds 5*a* nearer the lower surface of the channel 4. The ejection orifices 8 are formed in the lower surface of the channel 4 in the area corresponding to the piezoelectric actuator substrates 21. A group of ejection orifices 8, or each ejection orifice group, uses an area having substantially the same size and the same shape as the area of the corresponding piezoelectric actuator substrate 21. Droplets are ejected from the ejection orifices 8 by displacing the displacement elements 50 included in each piezoelectric actuator substrate 21. The ejection orifices 8 in each ejection orifice group are arranged at equal intervals along multiple straight lines parallel to the longitudinal direction of the channel 4.

The channel 4 included in the head body 13 has a stacked structure including multiple plates stacked on one another. These plates are, in order from the upper surface of the channel 4, a cavity plate 22, a base plate 23, an aperture plate 24, supply plates 25 and 26, manifold plates 27, 28, and 29, a cover plate 30, and a nozzle plate 31. These plates have a large number of holes. These plates are aligned and stacked on one another to allow the holes to communicate with one another to define the individual channels 32 and the sub-manifolds 5*a*. As shown in FIG. 5A, the head body 13 has the pressurizing chambers 10 in the upper surface of the channel 4, the sub-manifolds 5*a* inside the head body 13 nearer the lower surface, and the ejection orifices 8 in the lower surface. Thus, the parts defining each individual channel 32 are located adjacent to one another at different positions for each sub-manifold 5*a*, and the corresponding ejection orifice 8 are connected to one another through the corresponding pressurizing chamber 10.

These plates have holes described below. The first is the pressurizing chamber 10 defined in the cavity plate 22. The second is a communication hole defining a channel connecting an end of the pressurizing chamber 10 to the sub-manifold 5*a*. This communication hole is formed through the base plate 23 (specifically the entrance of the pressurizing chamber 10) to the supply plate 25 (specifically the exit of the sub-manifold 5*a*). This communication hole includes the aperture 12 in the aperture plate 24, and an individual supply channel 6 in the supply plates 25 and 26.

The third is a communication hole defining a channel connecting the other end of the pressurizing chamber 10 to the ejection orifice 8. This communication hole is hereafter referred to as a descender (partial channel). The descender is formed through the base plate 23 (specifically the exit of the pressurizing chamber 10) to the nozzle plate 31 (specifically the ejection orifice 8). The descender nearer the ejection orifice 8 has a particularly small cross section at its end, which functions as the ejection orifice 8 in the nozzle plate 31. A metal film 31*b* covers the surface of the nozzle plate 31. The metal film 31*b* will be described later.

The fourth is a communication hole defining the sub-manifold 5*a*. This communication hole is formed through the manifold plates 27 to 30.

These communication holes connect to each other to define the individual channel 32, which extends from the inlet (exit of the sub-manifold 5*a*) for the liquid from the sub-manifold 5*a* to the ejection orifice 8. A liquid supplied to the sub-manifold 5*a* is ejected from the ejection orifice 8 through the path described below. First, the liquid from the sub-manifold 5*a* flows upward through the individual supply channel 6 to one end of the aperture 12. The liquid then horizontally flows in the direction in which the aperture 12 extends, and reaches the other end of the aperture 12. Thereafter, the liquid flows upward to one end of the pressurizing chamber 10. The liquid further horizontally flows in the direction in which the pressurizing chamber 10 extends, and reaches the other end of the pressurizing chamber 10. While slightly displacing horizontally, the liquid then mostly flows down to the ejection orifice 8, which is open in the lower surface.

As shown in FIG. 5A, the piezoelectric actuator substrate 21 has a stacked structure including two piezoelectric ceramic layers 21*a* and 21*b*. These piezoelectric ceramic layers 21*a* and 21*b* each have a thickness of about 20 μm. The displacement element 50, which is a displaceable part of the piezoelectric actuator substrate 21, has a thickness of about 40 μm, which is not greater than 100 μm. The displacement element 50 can thus be displaced more. Both the piezoelectric ceramic layers 21*a* and 21*b* extend across multiple pressurizing chambers 10 (refer to FIG. 3). These piezoelectric ceramic layers 21*a* and 21*b* are formed from a ferroelectric lead zirconate titanate (PZT) ceramic material.

The piezoelectric actuator substrate 21 includes a common electrode 34, which is formed from, for example, a Ag—Pd-based metal material, and an individual electrode 35, which is formed from, for example, a Au-based metal material. As described above, the individual electrode 35 is located on the upper surface of the piezoelectric actuator substrate 21 at a position corresponding to the pressurizing chamber 10. The individual electrode 35 has one end including an individual electrode body 35*a*, which is located at a position corresponding to the pressurizing chamber 10, and an extraction electrode 35*b*, which is drawn out of the area corresponding to the pressurizing chamber 10.

The piezoelectric ceramic layers 21*a* and 21*b* and the common electrode 34 have substantially the same shape. The piezoelectric ceramic layers 21*a* and 21*b* and the common electrode 34 warp less when fired together. The piezoelectric actuator substrate 21 with a thickness of 100 μm or less tends to warp more when fired. The warped piezoelectric actuator substrate 21 is deformed before bonded to and stacked on the channel 4. The deformation can change the characteristics of the displacement element 50 and generates variations in the liquid ejection performance of the displacement element 50. The piezoelectric actuator substrate 21 may allow only warps that fall within the thickness of the piezoelectric actuator substrate 21. To reduce warps caused by a difference in firing contraction between parts with and without an internal electrode, an internal electrode 34 is formed entirely with no pattern. One layer having substantially the same shape as another herein refers to the shape having outer periphery dimensions different from the other within 1% of its width. The outer peripheries of the piezoelectric ceramic layers 21*a* and 21*b*, which are basically overlaid before fired and then cut together, are aligned within the range of the processing accuracy. The internal electrode 34, which are formed by being entirely printed and then cut concurrently with the piezoelectric ceramic layers 21*a* and 21*b*, warps less. The internal electrode 34, which is formed by printing in a pattern similar to and slightly smaller than the piezoelectric ceramic layers 21*a* and 21*b*, is prevented from being uncovered on the side surfaces of the piezoelectric actuator 21, and thus has high electrical reliability.

Although described in detail later, each individual electrode 35 receives a driving signal (driving voltage) from the controller 88 through a flexible printed circuit (FPC), which is external wiring. The driving signal is transmitted periodically in synchronization with the transport speed of the print medium P. The common electrode 34 is formed substantially in the entire area across a plane between the piezoelectric ceramic layers 21*a* and 21*b*. More specifically, the common electrode 34 extends over all the pressurizing chambers 10 in the area facing the corresponding piezoelectric actuator substrate 21. The common electrode 34 has a thickness of about 2 μm. The common electrode 34 is grounded in an area (not shown) and held at the ground potential. In the present embodiment, a surface electrode (not shown) different from the individual electrodes 35 is formed on the piezoelectric ceramic layer 21*b* in parts around an electrode group including the individual electrodes 35. The surface electrode is electrically connected to the common electrode 34 via a through-hole formed in the piezoelectric ceramic layer 21*b*, and connected to external wiring, similarly to the large number of individual electrodes 35.

As described later, in response to a predetermined driving signal that is selectively provided to each individual electrode 35, the pressure is applied to the liquid in the pressurizing chamber 10 corresponding to the individual electrode 35. Thus, droplets are ejected through the corresponding ejection orifice 8 via the individual channel 32. More specifically, the piezoelectric actuator substrate 21 includes the individual displacement element 50 (actuator) in its part facing each pressurizing chamber 10. The piezoelectric actuator substrate 21 is intended for the corresponding pressurizing chamber 10 and the ejection orifice 8. More specifically, each displacement element 50 having the structure shown in FIG. 5A as a unit structure for each pressurizing chamber 10 is formed inside a laminate including two piezoelectric ceramic layers with the diaphragm 21*a*, the common electrode 34, the piezoelectric ceramic layer 21*b*, and the individual electrode 35, which are located immediately above the pressurizing chamber 10. The piezoelectric actuator substrate 21 includes multiple displacement elements 50. In the present embodiment, the amount of liquid ejected from the ejection orifice 8 in a single ejection operation is about 5 to 7 picoliters (pL).

When the piezoelectric actuator substrate 21 is viewed from above, the individual electrode body 35*a* overlaps the pressurizing chamber 10. The part of the piezoelectric ceramic layer 21*b* located in the middle of the pressurizing chamber 10 and held between the individual electrode 35 and the common electrode 34 is polarized in the stacked direction of the piezoelectric actuator substrate 21. The piezoelectric ceramic layer 21*b* may be polarized in either the upward or downward direction, and can be driven with a driving signal in accordance with this direction.

As shown in FIG. 5A, the common electrode 34 and the individual electrode 35 hold only the uppermost layer or the piezoelectric ceramic layer 21*b* between them. The area of the piezoelectric ceramic layer 21*b* held between the individual electrode 35 and the common electrode 34 is referred to as an active area. The piezoelectric ceramic in the active area is polarized in the thickness direction. In the piezoelectric actuator substrate 21 according to the present embodiment, only the uppermost piezoelectric ceramic layer 21*b* includes the active area. The piezoelectric ceramic 21*a* including no active area serves as a diaphragm. The piezoelectric actuator substrate 21 has a unimorph structure.

With an actual driving procedure according to the present embodiment, the individual electrode 35 has its initial potential higher than the potential of the common electrode 34 (hereafter, high potential). Every time an ejection is requested, the individual electrode 35 temporarily has its potential lowered to the same potential as the common electrode 34 (hereafter, low potential), and then raised again at a predetermined timing. When the individual electrode 35 switches to a low potential, the piezoelectric ceramic layers 21*a* and 21*b* are recovered, and the pressurizing chamber 10 increases its capacity to more than in the initial state (the state where the two electrodes have different potentials). In this state, a negative pressure is applied to the pressurizing chamber 10, and the liquid is sucked into the pressurizing chamber 10 from the manifold 5. Subsequently, when the individual electrode 35 switches to a high potential again, the piezoelectric ceramic layers 21*a* and 21*b* deform outward toward the pressurizing chamber 10, and the pressurizing chamber 10 reduces the capacity to have its pressure changed to a positive pressure. The liquid has its pressure raised, and thus is ejected in droplets. More specifically, a driving signal including a pulse using a high potential as a reference is provided to the individual electrode 35 for ejecting droplets. The pulse ideally has a pulse width of the acoustic length (AL), which is the time length for which a pressure wave propagates in the pressurizing chamber 10 from the manifold 5 to the ejection orifice 8. Such a pulse causes droplets to be ejected with a higher pressure with the combination of the negative pressure and the positive pressure when the pressurizing chamber 10 is switched from under the negative pressure to the positive pressure.

The nozzle plate 31 includes a base 31*a*, which contains nickel as its main component, and a metal film 31*b*, which covers the surface of the base 31*a* and contains nickel and palladium as its main components. The base has through-holes 8*a*. The metal film 31*b* covers at least the inner walls of the through-holes 8*a*. Each through-hole 8*a* is a hole extending through the single base 31*a*, and each ejection orifice 8, which serves as a nozzle, is the through-hole 8*a* covered with the metal film 31*b*.

The nozzle plate 31 has a thickness of, for example, 20 to 100 μm. Each ejection orifice 8 has a circular cross-section, but may have a cross section with other rotationally symmetrical shapes such as an ellipse, a triangle, or a quadrangle. Each ejection orifice 8 tapers to have its cross-sectional area decreasing toward the ejection orifice surface 4-1. Each ejection orifice 8 has a tapering angle of, for example, 10 to 30 degrees with respect to the axis. A part of each ejection orifice 8 adjacent to the ejection orifice surface 4-1 may flare to have the cross-sectional area slightly increasing toward the ejection orifice surface 4-1. The opening of each ejection orifice 8 in the ejection orifice surface 4-1 has a diameter of, for example, 10 to 200 μm.

In the present embodiment, the metal film 31*b* almost entirely covers the inner walls of the through-holes 8*a* and the surface of the base 31. The nozzle plate 31 shown in FIG. 5B actually extends further leftward and rightward to areas outside the drawing. In FIG. 5A, the metal film 31 is not shown.

The base 31*a* is, for example, an electroformed film. The electroformed film is patterned to form the through-holes 8*a*. The through-holes 8*a* can be highly accurately formed with intended dimensions in the base 31*a* formed by electroforming. The through-holes 8*a* formed by, for example, punching or laser processing may have low repeat accuracy.

The base 31*a* contains nickel as its main component, and has a nickel content of higher than or equal to 95 at %. The components other than nickel are basically impurities. Thus, the nickel content may be higher than or equal to 98 at %, or more specifically 99 at %. The above nickel content is measured in the middle of the base 31*a* or more specifically in the middle of the base 31 in the thickness direction, which is spaced by half the thickness of the base 31 or further from, for example, the wall surfaces of the surrounding ejection orifices 8. Although described in detail later, the base 31*a* near the interface between the base 31*a* and the metal film 31*b* forms an oxygen rich layer 31*aa*, which has a higher oxygen content than a middle portion of the base 31*a*.

Although nickel may be used for forming an electroformed film, nickel has relatively low acid resistance. The ejection orifices 8 can deform after repeated ejection of an acid liquid, and can have lower ejection accuracy.

A water-repellent film may cover the nozzle surface 4-1 of the nozzle plate 31 to increase the contact angle with the film and the liquid used. The water-repellent film covers the surface of the metal film 31*b* when the metal film 31*b* is on the nozzle surface 4-1. The water-repellent film covers the surface of the base 31 when the metal film 31*b* is not on the nozzle surface 4-1. The film is referred to as a water-repellent film for convenience although the intended liquid may not be water-based. A typical water-repellent film is a thin film having a thickness less than or equal to several micrometers. Thus, the liquid used comes in contact with the underlying material through the water-repellent film. When an acid liquid is used and the underlying material is nickel, nickel may gradually corrode, resulting in delamination of water-repellent film. The water-repellent film peels because of the corrosion of the underlying material. Thus, a water-repellent film having high corrosion resistance to the intended liquid may not readily prevent such corrosion.

Nickel palladium containing nickel and palladium as its main components has higher corrosion resistance to, for example, acids than nickel. The metal film 31*b* formed from nickel palladium may cover the surface of the base 31*a* containing nickel as its main component to increase the corrosion resistance of the nozzle plate 31. The metal film 31*b* may have an average palladium content higher than or equal to 45 at %, or specifically higher than or equal to 55 at %, or more specifically higher than or equal to 75 at %. The metal film 31*b* having a higher palladium content has higher corrosion resistance. The metal film 31*b* may have an average palladium content of lower than or equal to 90 at %, or more specifically lower than or equal to 85 at %. The metal film 31*b* having a lower palladium content increases the bonding strength between the metal film 31*b* and the base, and reduces cost by using less expensive nickel.

The metal film 31*b* may be plated. The base 31*a* is to have less dirt on the surface before plated with the metal film 31*b*. In addition to simply cleaning the surface to reduce dirt, ashing is performed to remove components such as a carbon component by oxidizing the components. Ashing is performed by, for example, placing the nozzle plate 31 under a reduced pressure and exposing the nozzle plate 31 to oxygen plasma. Ashing forms an oxygen rich layer 31*aa*, which has a higher oxygen content than the middle portion of the base 31*a*, on the surface of the base 31*a*. The oxygen rich layer 31*aa* is thus obtained near an interface 31*c* of the base 31*a*.

The oxygen rich layer 31*aa* may have an average oxygen content of higher by 0.1 to 3 at % than the average oxygen content of the middle portion of the base 31*a*. The oxygen rich layer 31*aa* may have an average oxygen content of 1 to 4 at %. The oxygen rich layer 31*aa* has a thickness of about 10 to 300 nm.

Under higher ashing conditions, the oxygen rich layer 31*aa* has a high oxygen content and a large thickness. Under lower ashing conditions, the oxygen rich layer 31*aa* has a low oxygen content and a small thickness. Higher ashing conditions refer to the processing conditions facilitating oxidation, including, for example, use of a thicker oxidizing agent, such as oxygen, or an increased processing time. Ashing performed to form an oxygen rich layer 31*aa* having the average oxygen content of exceeding 1 at % effectively reduces dirt on the surface. The oxygen rich layer 31*aa* having the average oxygen content of below 4 at % reduces variations in the palladium content in the metal film 31*b*. This will be described below.

Ashing increases the oxygen content on the surface of the base 31*a*, but involves variations in the oxygen content. More specifically, the oxygen content of the oxygen rich layer 31*aa* is not uniform, and varies depending on locations. The oxygen content is basically highest at the interface 31*c*, and decreases further from the interface 31*c*. The oxygen content variation here is the variation in the direction along the interface 31*c*.

When the base 31*a* is plated with the metal film 31*b*, a current flows through the oxygen rich layer 31*aa*. Nickel having a high oxygen content has higher electric resistance than nickel having a low oxygen content. The oxygen rich layer 31*aa* having its oxygen content varying depending on the locations also has the varying electric resistance.

The oxygen rich layer 31*aa* having its oxygen content varying more increases the palladium content variation of the metal film 31*b*. This is probably caused by the difference in precipitation rate between nickel and palladium depending on the electric current that flows when the surface is plated with nickel and palladium. More specifically, the rate of palladium precipitation increases when the electric current increases. A part of the metal film 31*b* having its palladium content lowered by the variation has lower corrosion resistance than the surrounding part. That part with lower corrosion resistance may be locally corroded by, for example, an acid liquid, and the ejection orifices 8 may be deformed, or the water-repellent film may peel, as described above.

The metal film 31*b* may have a thickness of greater than or equal to 0.1 μm, or specifically greater than or equal to 0.5 μm. The metal film 31*b* having a thickness greater than the above is more likely to prevent the base 31*a* from being corroded by the liquid reaching the base 31*a*. The metal film 31*b* may have a thickness smaller than or equal to 5 μm, or speciflacly 3 μm. The metal film 31*b* having a thickness smaller than the above prevents an increase in the thickness variation, an increase in the shape variation of the ejection orifice 8, and the unevenness of the nozzle surface 4-1.

The palladium and oxygen contents may for example be measured in the manner described below. FIG. 5C is a cross-sectional view of the nozzle plate 31 observed with, for example, a transmission electron microscope (TEM). The interface 31*c* is located between the base 31*a* and the metal film 31*b*. The palladium content is measured at several points in the metal film 31*b* on an imaginary line A along the interface 31*c* using energy dispersive X-ray spectroscopy (EDS). In FIG. 5C, the interface 31*c* extends substantially linearly, and the imaginary line A is a straight line parallel to the interface 31*c*.

The distance from the interface 31*c* to the imaginary line A is, for example, 1 μm. When the metal film 31*b* has a thickness below 1 μm, the contents are measured in parts near the nozzle surface 4-1 within a measurable range. The contents are measured, for example, at four points with the spot diameter of 10 nm at the intervals of 40 nm on the imaginary line A. The variation of each content described below is the difference between the maximum and minimum values among the four measurement results. The content is the average of the four measurement results.

Similarly to the palladium ratio, the oxygen content is measured in the base 31*a* on the imaginary line B along the interface 31*c*. The distance from the interface 31*c* is, for example, 20 to 100 nm. The oxygen content basically increases toward the interface 31*c*. Thus, the oxygen content is measured in the part near the interface 31*c* within the range in which the metal film 31*b* near the interface 31*c* has a small effect considering the spot diameter.

The nozzle plates 31 were formed under different ashing conditions between condition A for obtaining an oxygen rich layer 31*aa* having an oxygen content of about 1.5 at %, condition B for obtaining an oxygen rich layer 31*aa* having an oxygen content of about 3.5 at %, and condition C for obtaining an oxygen rich layer 31*aa* having an oxygen content of about 6.5 at %. The nozzle plates 31 were then plated with palladium and nickel at the ratio of about 8 to 2. The palladium content and the oxygen content involve variations described below.

Under condition C, the palladium content variation is 5.5 at %, the oxygen content variation is 1.5 at %, and the nozzle plate 31 has its weight lost by 3.4% after immersed in acid ink. The nozzle plate 31 has its weight lost through partial dissolution with the ink. Under condition B, the palladium content variation is 3.2 at %, the oxygen content variation is 0.3 at %, and the nozzle plate 31 has its weight lost by 0.5% after immersed in acid ink. Under condition A, the palladium content variation is 2.5 at %, the oxygen content variation is 0.2 at %, and the nozzle plate 31 has its weight lost by 0.0% (less than 0.05%) after immersed in acid ink.

The base 31*a* ashed under condition B and then plated with palladium and nickel at the ratio of about 6 to 4 has a palladium content variation of 3.0 at % and an oxygen content variation of 0.5 at %, and the nozzle plate 31 has its weight lost by 0.8% after immersed in acid ink.

The metal film 31*b* having a palladium content variation smaller than or equal to 4 at %, or specifically 3 at % increases the corrosion resistance of the nozzle plate 31. To increase the corrosion resistance, the oxygen rich layer 31*aa* may have an oxygen content variation smaller than or equal to 1 at %, specifically 0.5 at %, or more specifically 0.3 atoms. To further reduce the oxygen content variation of the oxygen rich layer 31*aa*, the oxygen rich layer 31*aa* may have an oxygen content smaller than or equal to 4 at %, or specifically 2 at %.

Under higher ashing conditions, the middle portion of the base 31*a* has a higher oxygen content: 0.8 at % under condition A, 1 at % under condition B, and 1.5 at % under condition C. The middle portion of the base 31*a* may have an oxygen content smaller than or equal to 1 at %.

Although the metal film 31*b* having a high palladium content has high corrosion resistance, the content variation has a larger effect on the corrosion resistance rather than the average content. This is probably because the variation causes a part having a lower palladium content than the measured part to be corroded with acid ink or causes a part having a lower palladium content in a range narrower than the measured spot diameter to be corroded with acid ink first, and then allows other parts to be corroded further. The base 31*a* ashed under condition C and plated with palladium and nickel at the ratio of about 8 to 2 has a palladium content variation of 5.5 at %, and the nozzle plate 31 has its weight lost by 3.4%. In contrast, the base 31*a* ashed under condition B and plated with palladium and nickel at the ratio of about 6 to 4 has a palladium content variation of 3.2 at %, and the nozzle plate 31 has its weight lost by 0.8%. The nozzle plate 31 having a smaller palladium content variation loses less weight and has higher corrosion resistance at a smaller palladium content.

Subsequently, a method for manufacturing the nozzle plate 31 having the above ejection orifices 8 will now be described. An electroforming substrate formed from a metal such as a stainless steel is prepared first. Then, a negative photoresist film is formed on the electroforming substrate.

A photomask having a mask pattern designed to form the through-holes 8*a* of the intended dimensions and arrangement is prepared. The photoresist film is exposed to light through the photomask. The photomask allows light to pass through in parts forming the through-holes 8*a*. The parts of the photoresist film receiving light cure. Uncured parts are then dissolved and removed with a developer to leave cured parts.

Subsequently, the electroforming substrate is plated with nickel to form an electroformed film, which serves as the base 31*a*. The electroformed film is not formed in the parts with the cured photoresist film being left. These parts form the through-holes 8*a*. The photoresist film inside the through-holes 8*a* are removed using an agent such as an organic solvent. The electroformed film is then removed from the electroforming substrate to complete the base 31*a* having the through-holes 8*a*.

The base 31*a* is ashed with oxygen to reduce dirt including carbon or residues of the photoresist film on the surface of the base 31*a*. Thus, the oxygen rich layer 31*aa* is obtained on substantially the entire surface of the base 31*a*. Ashing is performed for the base 31 to obtain the nozzle plate 31 with the oxygen rich layer 31*aa* having an oxygen content of higher than or equal to 1 at %. Such ashing effectively reduces carbon and other dirt on the surface of the base 31.

The base 31*a* may be nickel-strike-plated over substantially the entire surface. The nickel-strike-plated base 31*a* is more firmly bonded with the nickel-palladium metal film 31*b*. The nickel-strike-plated layer has a thickness of, for example, about 20 to 200 nm. Nickel precipitates through the nickel strike plating. Thus, the nickel-strike-plated layer is included in the base 31*a*. The nickel-strike-plated layer is more likely to have a lower oxygen content than the oxygen rich layer 31*aa*. To measure the oxygen content and the oxygen content variation in the oxygen rich layer, the oxygen content is measured from the interface 31*c* between the base 31*a* and the metal film 31*b* toward the base 31*a* to determine the distance from the interface 31*c* to a part having a high oxygen content, and then the oxygen content and the variation are measured on an imaginary line B spaced at the determined distance from the interface 31*c*. A thin film with a thickness of about several hundred nanometers at maximum having another composition may be located between the base 31*a* and the metal film 31*b*.

Subsequently, the base 31*a* is plated with nickel and palladium to form the metal layer 31*b*, which is a plated film. The surface of the metal layer 31*b* may be covered with, for example, a water-repellent film using a material such as fluororesin or carbon.

REFERENCE SIGNS LIST

1 printer
2 liquid ejection head
4 channel
5 manifold
5*a* sub-manifold
5*b* manifold opening
6 individual supply channel
7 nozzle mount area
8 ejection orifice (nozzle)
8*a* through-hole
9 pressurizing chamber group
10 pressurizing chamber
11*a*, 11*b*, 11*c*, and 11*d* pressurizing chamber row
12 aperture
13 head body
15*a*, 15*b*, 15*c*, and 15*d* ejection orifice row
21 piezoelectric actuator substrate
21*a* piezoelectric ceramic layer (ceramic diaphragm)
21*b* piezoelectric ceramic layer
22 to 30 plate
31 plate (nozzle plate)
31*a* base
31*aa* oxygen rich layer
31*b* metal film
31*c* interface (between base and metal film)
32 individual channel
34 common electrode
35 individual electrode
35*a* individual electrode body
35*b* extraction electrode
36 connection electrode
50 displacement element
70 head mount frame
72 head group
80A feed roller
80B rewind roller
82A guide roller
82B transport roller
88 controller
A, B imaginary line
P print paper

The invention claimed is:

1. A nozzle plate, comprising:
a base having a through-hole to be a nozzle; and
a metal film covering at least an inner wall of the through-hole of the base,
wherein the base contains nickel as a main component,
the metal film contains nickel and palladium as main components,
in a cross section including the base and the metal film, the metal film has a palladium content variation smaller than or equal to 4 at % on an imaginary line A along an interface between the base and the metal film, and
the base includes, at a location adjacent to the interface, an oxygen rich layer having a higher oxygen content than a middle portion of the base.

2. The nozzle plate according to claim 1, wherein
the metal film has a thickness of 0.1 to 5 μm.

3. The nozzle plate according to claim 1, wherein
in a cross section including the base and the metal film, the oxygen rich layer has an oxygen content variation smaller than or equal to 1 at % on an imaginary line B along the interface between the base and the metal film.

4. The nozzle plate according to claim 1, wherein
the oxygen rich layer on the imaginary line B has an average oxygen content of 1 to 4 at %.

5. The nozzle plate according to claim 1, wherein
the middle portion of the base has an oxygen content smaller than or equal to 1 at %.

6. A liquid ejection head, comprising:
the nozzle plate according to claim 1;
a pressurizing chamber connecting to the through-hole; and
a pressurizer configured to pressurize the pressurizing chamber.

7. A recording device, comprising:
the liquid ejection head according to claim 6;
a transport unit configured to transport a recording medium to the liquid ejection head; and
a controller configured to control the liquid ejection head.

* * * * *